United States Patent [19]

Hayashi

[11] Patent Number: 4,859,549

[45] Date of Patent: Aug. 22, 1989

[54] METHOD OF FORMING A FLUORESCENT SCREEN FOR A COLOR CRT

[75] Inventor: Masatake Hayashi, Kanagawa, Japan

[73] Assignee: Sony Corporation, Tokyo, Japan

[21] Appl. No.: 166,006

[22] Filed: Mar. 9, 1988

[30] Foreign Application Priority Data

Mar. 12, 1987 [JP] Japan ..... 62-57766
Mar. 13, 1987 [JP] Japan ..... 62-58211

[51] Int. Cl.[4] ..... G03C 5/00

[52] U.S. Cl. ..... 430/23; 430/24; 430/25; 430/26; 430/30; 313/408

[58] Field of Search ..... 430/23, 24, 25, 26, 430/30, 396, 27, 4, 5; 313/364, 402, 408, 403; 354/1; 358/242

[56] References Cited

U.S. PATENT DOCUMENTS 3,652,895 3/1972 Tsuneta et al. ..... 430/23
3,856,525 12/1974 Inoue ..... 430/24
4,162,421 7/1979 Morrell ..... 313/403
4,271,247 6/1981 Morrell ..... 430/24
4,296,189 10/1981 Kuzminski ..... 430/23
4,303,466 12/1981 Thoms ..... 430/23
4,475,797 10/1984 Park ..... 430/26

*Primary Examiner*—Jose G. Dees
*Assistant Examiner*—Donald J. Loney
*Attorney, Agent, or Firm*—Hill, Van Santen, Steadman & Simpson

[57] ABSTRACT

A method of forming a fluorescent screen for a color CRT, by exposing a photosensitive film on the inner surface of a curved panel, to form color stripes with different stripe widths. A flat mask is used, with slits aligned with the curved panel. The spacing of the mask and the width of the slits are controlled to produce a predetermined pattern factor F according to the expression:

$$F = A\sqrt{2/(b\lambda)}$$

where A is the width of the slits in the mask, b is the distance between the mask and the panel surface, and λ is the wavelength of the exposing light.

2 Claims, 10 Drawing Sheets

Fig 3.A
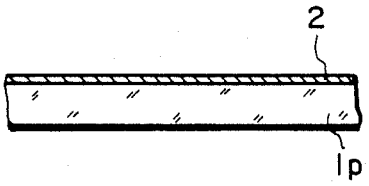
Fig 3.E
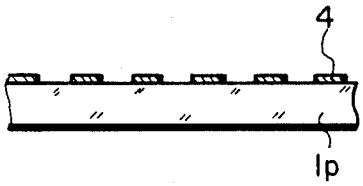
Fig 3.B
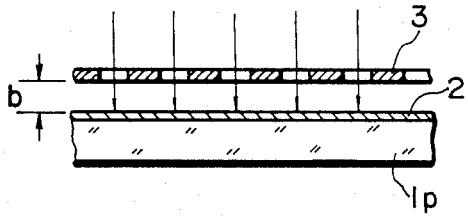
Fig 3.F
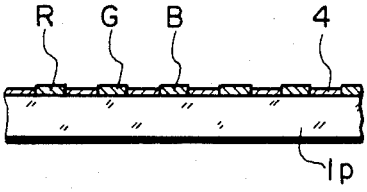
Fig 3.C
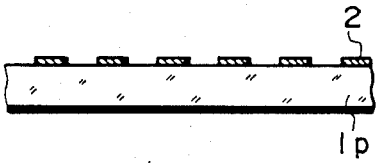
Fig 3.G
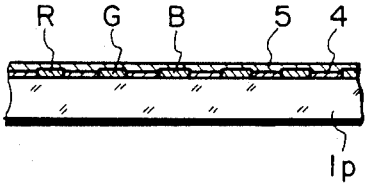
Fig 3.D
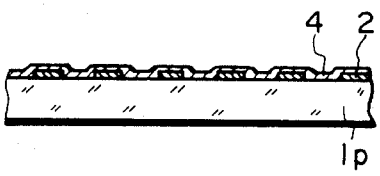
Fig 3.H
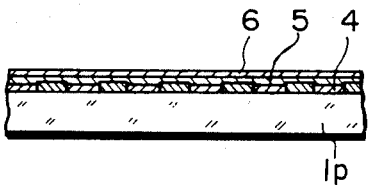

METHOD OF FORMING A FLUORESCENT SCREEN FOR A COLOR CRT

BACKGROUND OF THE INVENTION

1. Field of the Invention

The present invention relates to a method of forming a fluorescent screen for a color CRT (cathode-ray tube) and, more particularly, to a method of forming a fluorescent screen for an index color CRT.

2. Description of the Prior Art

In a color CRT manufacturing process, fluorescent materials respectively for different colors, for example, a red fluorescent material, a green fluorescent material and a blue fluorescent material, are applied respectively in predetermined patterns to the inner surface of a panel 1P separate from the funnel-shaped body 1 of a color CRT, and then the panel 1P is joined to the funneled open end of the body 1 with frit as shown in FIG. 2. Ordinarily, light-absorbing stripes CS of a light-absorbing mateial such as carbon are formed between and in front of the adjacent stripes of red, green and blue fluorescent materials to improve the contrast of pictures. Accordingly, the respective effective widths of the red, green and blue fluorescent stripes are dependent on intervals between the light-absorbing CS stripes. The pattern of the light-absorbing stripes CS is formed through steps of exposing a photosensitive resin film such as a PVA-ADC film formed over the inner surface of the panel in a pattern of the color fluorescent stripes, developing the pattern of the color fluorescent stripes, applying a light-absorbing material such as carbon to the entire inner surface of the panel over the pattern of the color fluorescent stripes, and removing the pattern of the color fluorescent stripes of the photosensitive resin film. Therefore, the respective widths of the red, green and blue stripes are dependent on the condition of exposure of the corresponding portions of the photosensitive film. In a color CRT such as a Trinitron (a registered trademark of Sony Corporation) color CRT, in which an aperture grill having slits is used for separating colors from each other, the aperture grill is used as a mask for exposing the photosensitive resin film formed over the inner surface of the panel, and a single light source is moved relative to the aperture grill for three exposure cycles respectively for the red, green and blue patterns of stripes or three light sources are used individually for exposing portions respectively corresponding to the red, green and blue patterns of stripes.

However, since the beam index color CRT is not provided with any aperture grill having slits for color separation, an exposure mask having slits, for example, a flat mask formed by forming a shading pattern over the surface of an ordinary flat glass plate, is used for exposing a photosensitive resin film formed over the inner surface of the panel, and the photosensitive resin film is exposed in the foregoing exposure method in manufacturing the beam index color CRT.

However, the foregoing conventional method has problems in the accuracy of the relative position between the light source and the exposure mask. From the viewpoint of facilitating the work for forming the light-absorbing stripes CS and productivity, it is desirable to form the light-absorbing stripes CS through a single exposure cycle using a single point light source.

The respective widths of the red, green and blue fluorescent stripes vary, depending on the respective luminance efficiencies of the red, green and blue fluorescent materials, and the width of the color fluorescent stripe in the central portion of the panel and that in the peripheral portion of the same are not the same, to secure color purity in the peripheral portion of the panel For example, when a flat exposure mask having slits each of a width proportional to the width of the corresponding fluorescent stripe to be formed is used for exposing a photosensitive resin film formed over the inner surface of a panel for a beam index color CRT, the fluorescent stripe is not formed in a width proportional to the width of the corresponding slit.

Generally, the panel for a color CRT is formed in a curved plane with a curvature. Accordingly, such a flat exposure mask is unable to expose some part of the fluorescent resin film formed over the inner surface of the panel correctly in a predetermined exposure pattern, and hence an irregular exposure pattern is formed on the inner surface of the panel, or the width of the stripe of the exposure pattern varies depending on position. It is inferred from studies made by the inventors of the present invention that such a problem is attributable to incorrect correspondence between the width of the slit of the exposure mask and the width of the stripe of the exposed pattern, due to diffraction. Suppose that an exposure mask and an exposed surface (the photosensitive resin film formed over the inner surface of the panel) are spaced by a finite distance. Then, it is known that light intensity varies in a distribution curve on the exposed surface due to diffraction when the exposure light is substantially monochromatic light. Supposing that a surface of a panel is exposed by a light source emitting monochromatic light using an exposure mask having a slit and that the light source is located at a sufficiently large distance from the surface, the pattern of diffraction is dependent on the pattern factor F expressed by an expression:

$$F = A\sqrt{2/(b\lambda)} \tag{1}$$

where A is the slit width, b is the distance between the exposure mask and the exposed surface of the panel, and $\lambda$ is the wavelength of the light emitted by the light source. Values of the width of stripes formed on the panel were calculated by using the expression (1), in which the wavelength $\lambda$ and the distance b were fixed and the slit width A was varied. The calculated results are represented by a curve $T_0$ indicated by a solid line in FIG. 11. The range of stripe width was determined so that light intensity is greater than a threshold corresponding to the half of light intensity when the exposure mask is not provided with any slit. As obvious from the curve $T_O$, the stripe width on the panel does not vary in proportion to the slit width of the exposure mask, so that the problem mentioned above is caused.

The diffraction pattern varies, as shown in FIGS. 4 to 10, depending on exposure conditions represented by F, the slit width A, the distance b and the wavelength $\lambda$. FIGS. 4 to 10 show diffraction patterns under the exposure conditions as tabulated below.

| F | Slit width A (mm) | Distance b (mm) | Wavelength $\lambda$ ($\mu$) | FIG. |
|---|---|---|---|---|
| 2.4 | 0.20 | 34.7 | 0.40 | 4 |
| 3.2 | 0.20 | 19.5 | 0.40 | 5 |
| 3.4 | 0.20 | 17.3 | 0.40 | 6 |
| 3.8 | 0.20 | 13.9 | 0.40 | 7 |

-continued

| F | Slit width A (mm) | Distance b (mm) | Wavelength λ (μ) | FIG. |
|---|---|---|---|---|
| 5.4 | 0.20 | 6.9 | 0.40 | 8 |
| 6.3 | 0.20 | 5.0 | 0.40 | 9 |
| 9.6 | 0.20 | 2.2 | 0.40 | 10 |

In FIGS. 4 to 10, light intensity is measured on the vertical axis, and the distance on the panel along the direction of the slit width is measured on the horizontal axis. The diffraction pattern varies with the distance b, which varies due to the curvature of the panel, and thereby irregular exposure is caused.

Such a problem may be solved by the use of a curved exposure mask. However, a curved exposure mask is expensive and is difficult to manufacture.

SUMMARY OF THE INVENTION

Accordingly, it is an object of the present invention to provide a method of forming a fluorescent screen for a color CRT, capable of forming a plurality of kinds of stripes respectively having desired widths in a photosensitive film formed over the inner surface of a panel, through a single exposure cycle.

It is another object of the present invention to provide a method of forming a fluorescent screen for a color CRT, capable of satisfactorily and uniformly exposing a photosensitive film formed over the inner surface of a curved panel by using a fiat exposure mask.

According to one aspect of the present invention, there is provided a method of forming a fluorescent screen for a color CRT by disposing a flat mask having three kinds of slits opposite to a photosensitive film formed over the inner surface of a curved panel to form stripes respectively having different widths in the photosensitive film through a single exposure cycle, characterized in that the value of the pattern factor F expressed:

$$F = A\sqrt{2/(b\lambda)}$$

where A is the slit width, b is the distance between the flat mask and the inner surface of the panel, and λ is the wavelength of light emitted by a light source. A selectively determined by fixing the distance b and the wavelength λ and varying the slit width A so as to meet an expression:

$$b_O = b_c/\{1-(A_1/A_0)^2\}$$

where $A_O$ is the width of the slit in the central portion of the flat mask, $A_1$ is the width of the slit in the peripheral portion of the flat mask, $b_O$ is the distance between the central portion of the flat mask and the inner surface of the panel, $b_1$ is the distance between the peripheral portion of the flat mask and the inner surface of the panel, and $b_c$ is the difference between the distances $b_0$ and $b_1$.

When the slit width A of the flat mask is selectively determined so that the value of F is, for example, about 2.5, 3.2 or 3.9, stripes respectively having different stripe widths corresponding to the slit width A of the flat mask as shown in the dashed line in FIG. 11 are formed simultaneously in the photosensitive film formed over the inner surface of the panel through a single exposure cycle.

Although the shape of a diffraction pattern when a slit mask is used is practically dependent on the value of F, the width of fluorescent stripes of a color CRT is varied to make the duty factor (white factor) in the peripheral portion of the panel lower than that in the central portion of the panel to secure color purity in the peripheral portion of the panel. Therefore, when the expression $$b_0 = b_c/\{1-(A_1/A_0)^2\}$$

is satisfied, the value of F is constant over the entire area of the panel and hence the entire area of the panel can be exposed uniformly in the substantially same diffraction pattern. Since the slit widths $A_0$ and $A_1$ are dependent on design conditions, and $b_c$ is dependent on the curvature of the panel, the distance $b_O$ between the central portion of the mask and the inner surface of the panel is determined properly.

BRIEF DESCRIPTION OF THE DRAWINGS

The above and other objects, features and advantages of the present invention will become apparent from the following description taken in conjuction with the accompanying drawings, in which:

FIGS. 1, 3A, 3B, 3C, 3D, 3E, 3F, 3G and 3H are sectional views of assistance in explaining steps of a method of forming a fluorescent screen for a color CRT, in a preferred embodiment, according to the present invention;

DESCRIPTION OF THE PREFERRED EMBODIMENT

Figure 1:
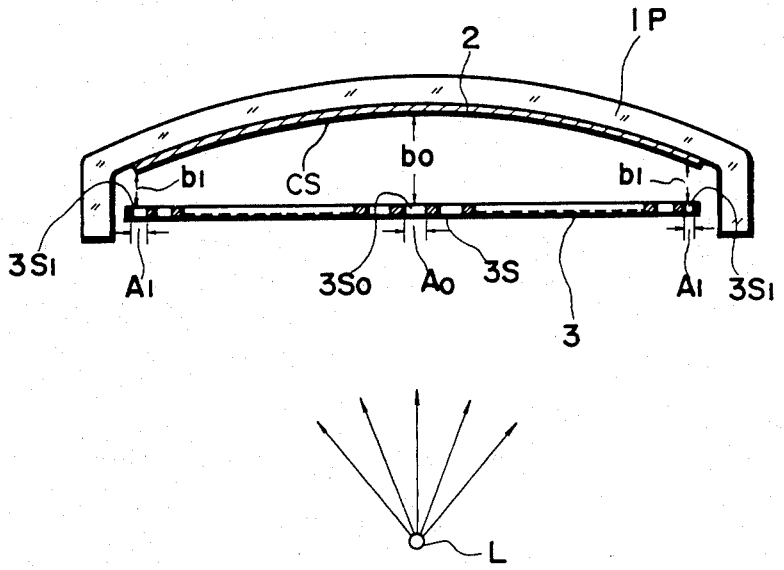
Figure 2:
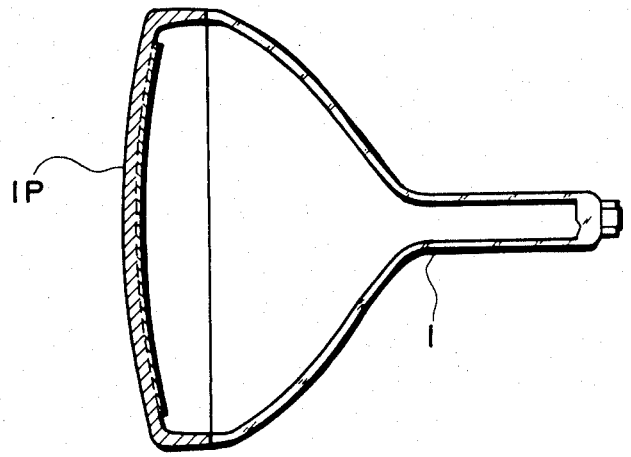
FIG. 2 is a sectional view of a color CRT.
Figure 4:
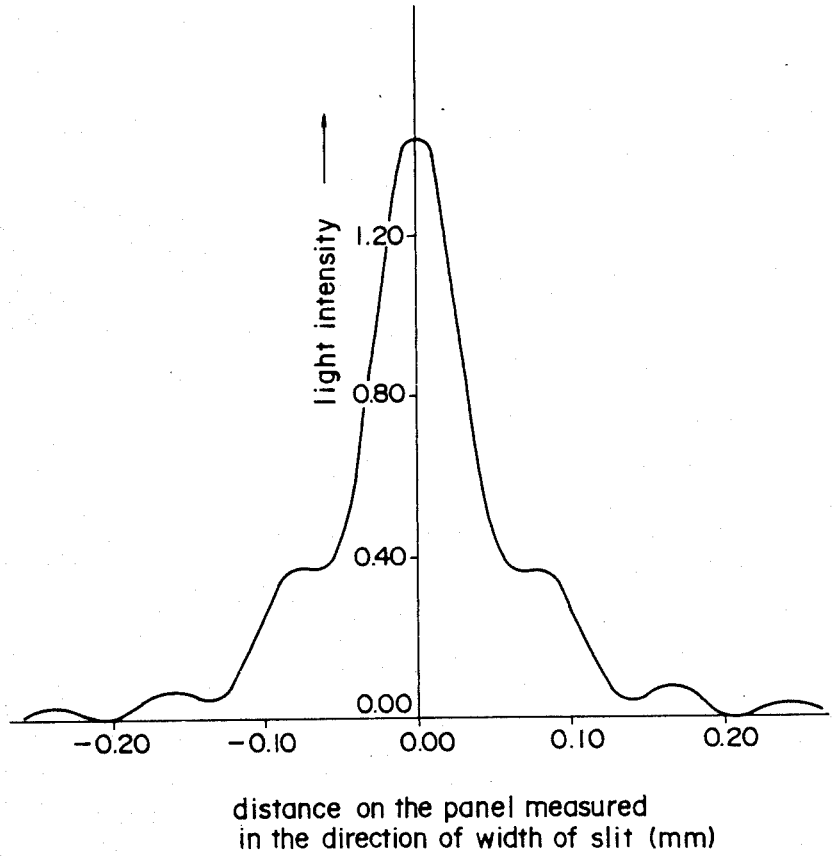
FIGS. 4–10 are diagrams of diffraction patterns on the inner surface of a panel.

Referring to FIG. 2, a beam index color CRT comprises a body 1 and a panel 1P separate from the body 1. Different color fluorescent materials, for example, red, green and blue fluorescent materials, are applied respectively in predetermined patterns to the inner surface of the panel 1P to form a color fluorescent screen, and then the panel 1P is joined to the funnel-shaped open end of the body 1 with frit. In this embodiment, light-absorbing stripes CS for determining the respective widths of red, green and blue fluorescent stripes are formed through steps which will be described with reference to FIGS. 1 and 3A to 3H.

First, as shown in FIG. 3A, a photosensitive resin is applied to the inner surface of the panel 1P, for example, by a rotational film forming process, and then the photosensitive resin applied to the inner surface of the panel 1P is dried to form a photosensitive resin film 2.

Then, as shown in FIGS. 1 and 3B, a mask 3 formed of a flat glass plate having slits 3S is disposed at a predetermined distance b from the inner surface of the panel 1P and opposite to the photosensitive resin film 2 formed over the inner surface of the panel 1P so that the slits 3S correspond respectively to portions in the photosensitive resin film 2 to which red, green and blue fluorescent materials are to be applied. In this embodiment, the respective widths of the slits of the mask 3 respectively corresponding to the respective stripe widths of the red, green and blue fluorescent stripes, and the respective widths of the slits of the mask 3 respectively corresponding to the respective stripe widths of the fluorescent stripes in the central portion and in the peripheral portion of the fluorescent screen are determined so as to meet the relation represented by the curve $T_O$ in FIG. 11 to selectively determine F expressed by the expression (1) at a value on the order of 2.5. For example, when the respective slit widths of the slits respectively corresponding to the fluorescent stripes in the central portion of the fluorescent screen and those in the peripheral portion of the fluorescent screen are determined so that F is between 2.0 and 2.9, the ratio of the strip width of the fluorescent stripes in the central portion of the fluorescent screen to that of the fluorescent stripes in the peripheral portion of the screen is on the order of 1/1.8.

After the mask 3 meeting, the foregoing conditions have been disposed properly, a single exposure cycle is carried out by using a light source L such as a mercury-arc lamp.

Then, the photosensitive resin film 2 is subjected to a developing process after removing the mask 3. The exposed portions of the photosensitive resin film 2 remain on the panel 1P in a predetermined pattern of photosensitive resin stripes respectively having different predetermined widths, while the rest of the portions are removed as shown in FIG. 3C.

Then, the entire surface of the panel 1P including the pattern of stripes is coated with a layer of a light-absorbing material, such as a carbon layer 4, as shown in FIG. 3D. Then, the pattern of the photosensitive resin stripes is removed by using a solvent capable of dissolving the photosensitive resin film 2, such as hydrogen peroxide, to remove portions of the layer of the light-absorbing material selectively to form a pattern of light-absorbing stripes (guard band) 4 as shown in FIG. 3E. The pattern of the light-absorbing stripes 4 and the pattern of the photosensitive resin stripes are complementary.

Then, fluorescent stripes of different colors, namely, red fluorescent stripes R, green fluorescent stripes G and blue fluorescent stripes B, are formed sequentially in the spaces between the light-absorbing stripes 4 as shown in FIG. 3F by an optical printing process. In forming the fluorescent stripes of each color by the optical printing process, a photosensitive fluorescent slurry containing fluorescent powder of the corresponding color is applied to the inner surface of the panel 1P having the light-absorbing stripes 4 to form a photosensitive fluorescent film, the photosensitive fluorescent film is dried, the photosensitive fluorescent film is exposed in a predetermined pattern of the color fluorescent stripes, and then the pattern of the color fluorescent stripes is developed, and the rest of portions of the photosensitive fluorescent film are removed.

Then, a filming material, such as acrylic resin, is applied to the panel 1P over the color fluorescent stripes R, G and B, and the light-absorbing stripes 4, to form an intermediate film 5. Then, the intermediate film 5 is dried to form a smooth surface as shown in FIG. 3G. Then, the surface of the intermediate film 5 is coated with a metal backing layer, such as an aluminum layer, for example, by evaporation as shown in FIG. 3H.

In this embodiment, the slit width A of the mask 3 is determined selectively so that the value of F expressed by the expression (1) is on the order of 2.5, at which the strip width of the panel 1P is proportional to the slit width A. Accordingly, the photosensitive resin stripes are formed respectively in desired widths on the inner surface of the panel 1P, and a desired number of photosensitive stripes respectively having desired widths can simultaneously be formed through a single exposure cycle by using a single point light source without entailing problems in positioning accuracy. Thus, the present invention facilitates forming the fluorescent screen and improves the productivity.

Figure 11:
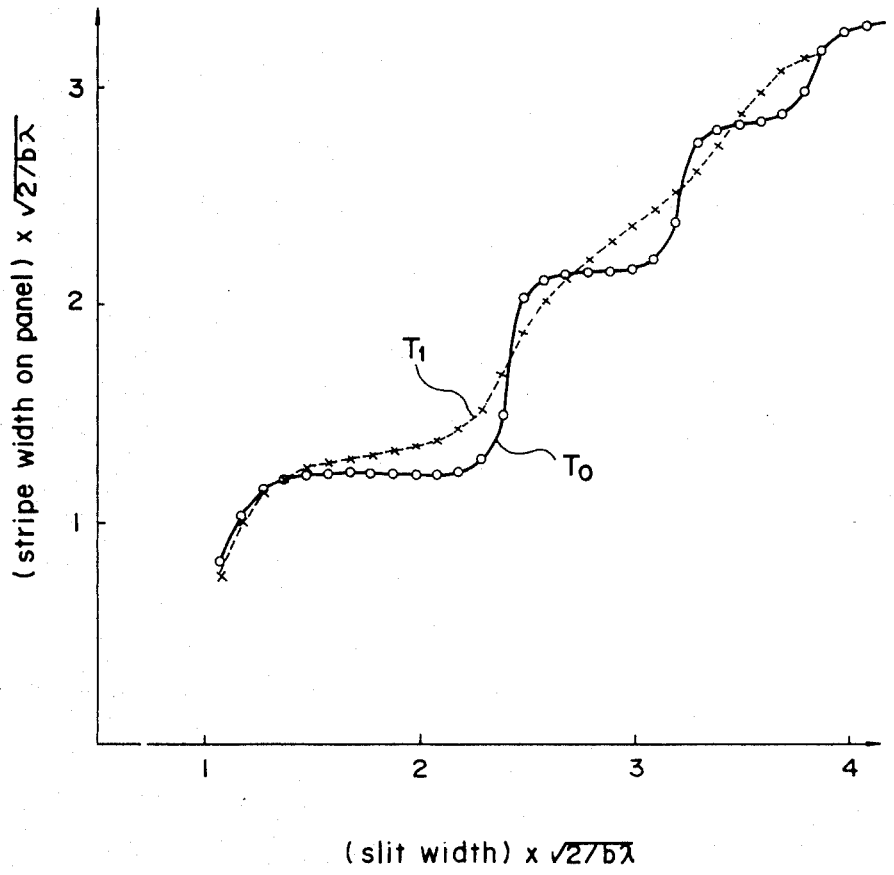
FIG. 11 is a graph of assistance in explaining the present invention.

Although the value of F (the expression (1)) in this embodiment is on the order of 2.5, it is obvious from FIG. 11 that the present invention provides the same effect when the value of F is, for example, on the order of 3.2 or 3.9.

It is possible to suppress the adverse influence of diffraction on forming the photosensitive stripes by employing a wide light source in order to make uniform the distribution of light intensity over the inner surface of the panel 1P when the inner surface of the panel 1P is illuminated through the mask 3. The curve $T_O$ in FIG. 11 represents the relation between the slit width of the mask 3 and the stripe width on the panel 1P when the width of the light source L is 0.3 mm, and a curve $T_1$ indicated by a broken line in FIG. 11 represents the same relation when the width of the light source L is 0.9 mm. As obvious from the curve $T_1$, the stripe width on the panel 1P is substantially proportional to the slit width of the mask 3 when the width of the light source L is 0.9 mm. When the light source L is a linear light source, such as a mercury-arc lamp, the width of the light source L can be increased by disposing the light source L slightly obliquely relative to a line parallel to the slit 3S of the mask 3. Thus, according to the present invention, the value of F (the expression (10) is determined selectively and the width of the light source L may properly be increased.

Generally, the color fluorescent stripes in the central portion of the panel 1P of a color CRT and those in the peripheral portion of the same are varied from each other in width so that the duty ratio (white ratio) of the peripheral portion of the panel 1P is lower than that of the central portion of the panel 1P to secure color purity in the peripheral portion of the panel 1P. In this embodiment, the slit width $A_O$ in the central portion of the mask 3 and the slit width $A_1$ in the peripheral portion of the same are determined so as to meet an expression:

$$A_1/A_0=h \tag{2}$$

where h is the ratio of the duty ratio of the peripheral portion of the panel 1P to that of the central portion of the panel 1P. Since the diffraction pattern in the central portion of the panel 1P is the same as that in the peripheral portion of the panel 1P when the value of F (the expression (1)) is fixed, the ratio h may be regarded as the ratio of the slit width in the peripheral portion of the mask 3 to that in the central portion of the same.

Since the panel 1P is curved, $$b_1-b_O=b_c \tag{3}$$

where $b_0$ is the distance between the mask 3 and the panel 1P at the center of the mask 3, $b_1$ is the distance between the mask 3 and the panel IP at the periphery of the mask 3, and $b_c$ is the difference between $b_0$ and $b_1$.

The value of F is fixed both in the central portion and peripheral portion of the panel IP when $$A_1/\sqrt{b_1} = A_0/\sqrt{b_0} \tag{4}$$

Therefore, from the expressions (2), (3) and (4), $$b_0=b_c/(1-h^2)=b_c/\{1-(A_1/A_O)^2\}$$

Figure 5:
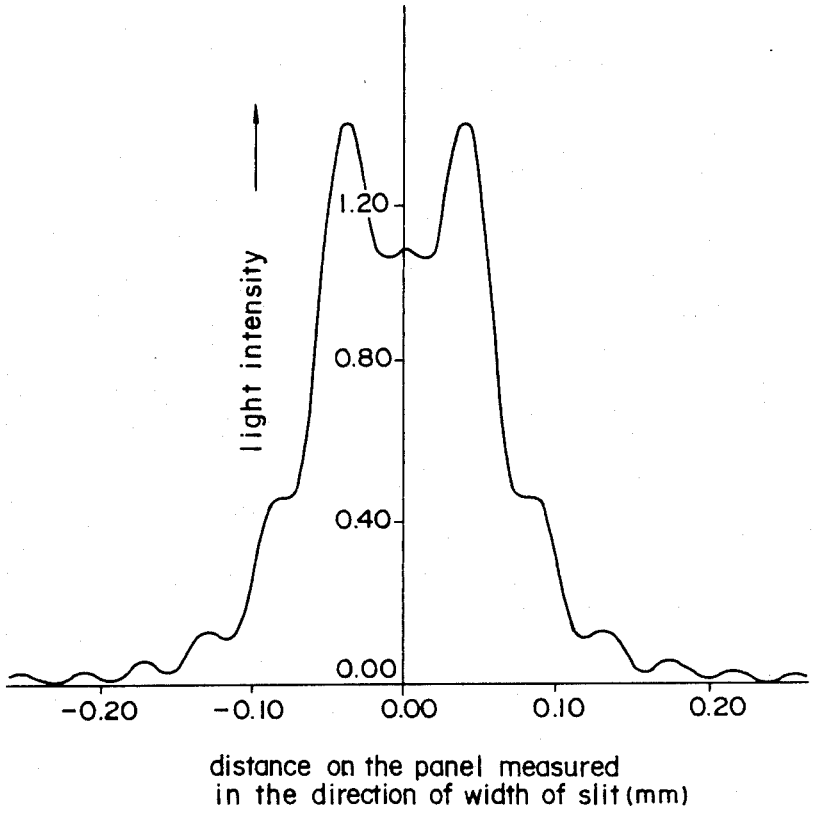
Figure 6:
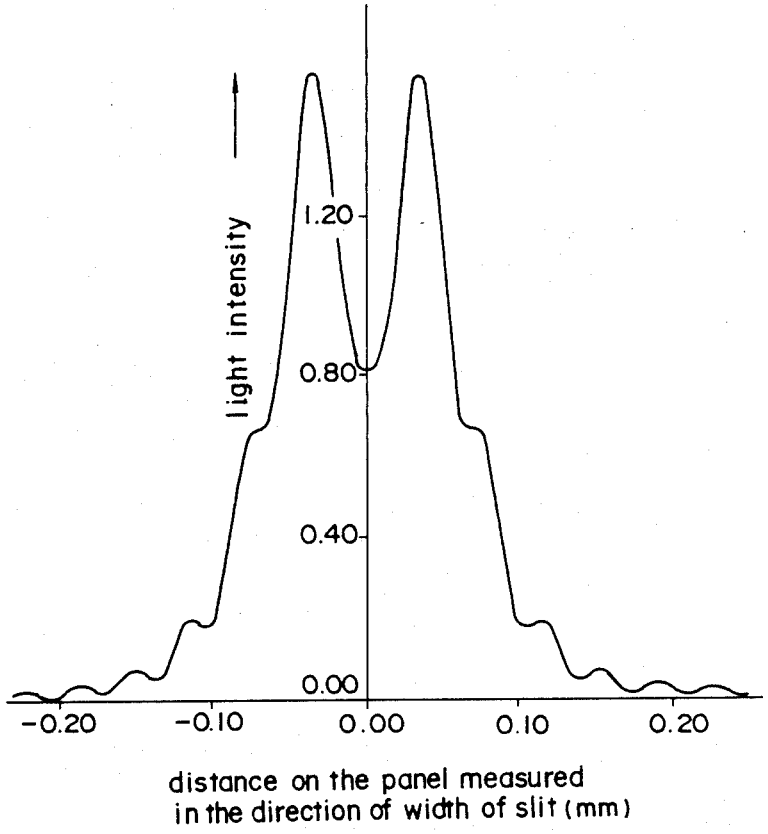
Figure 7:
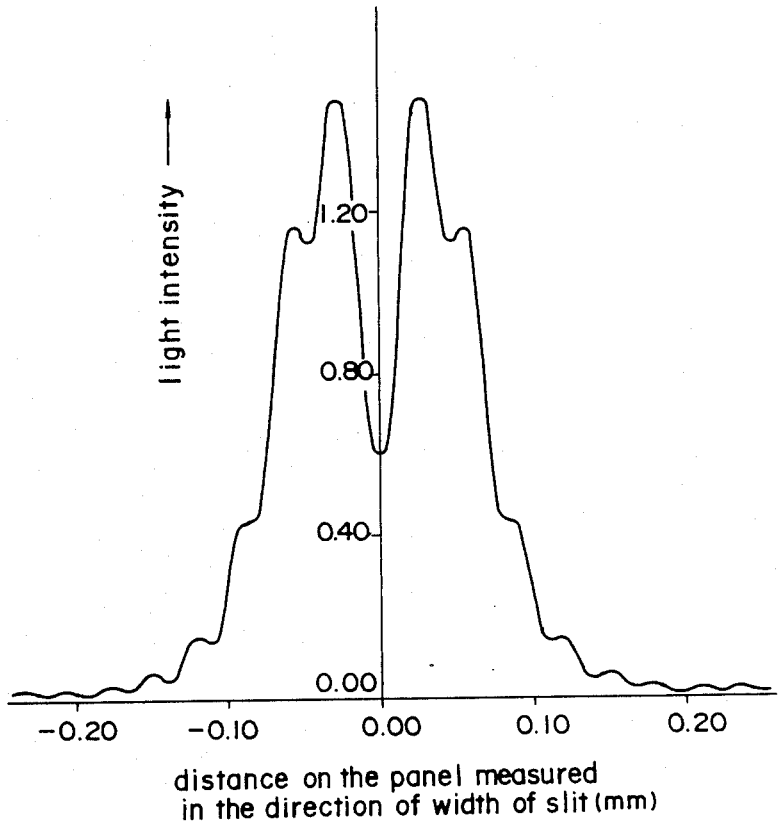
Figure 8:
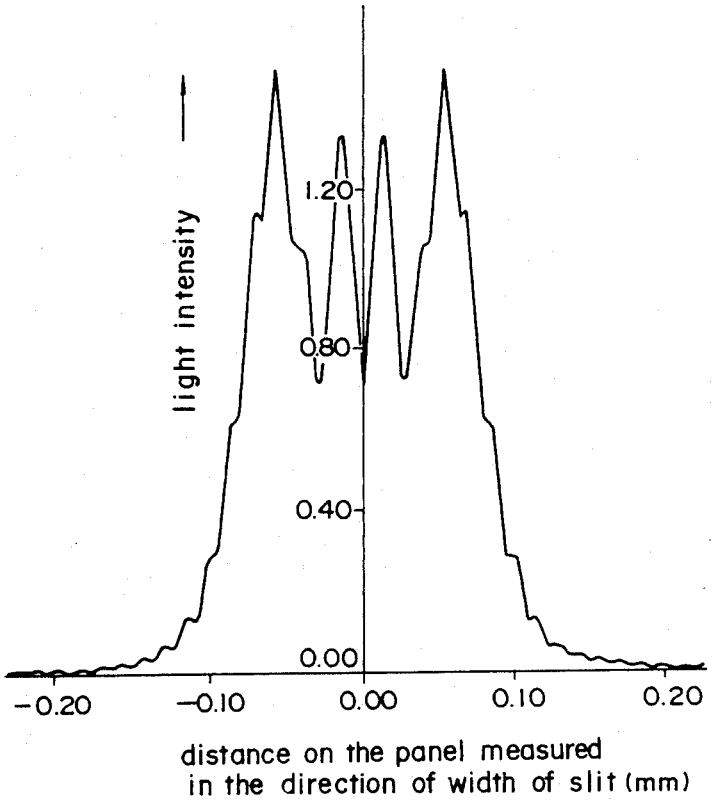
Figure 9:
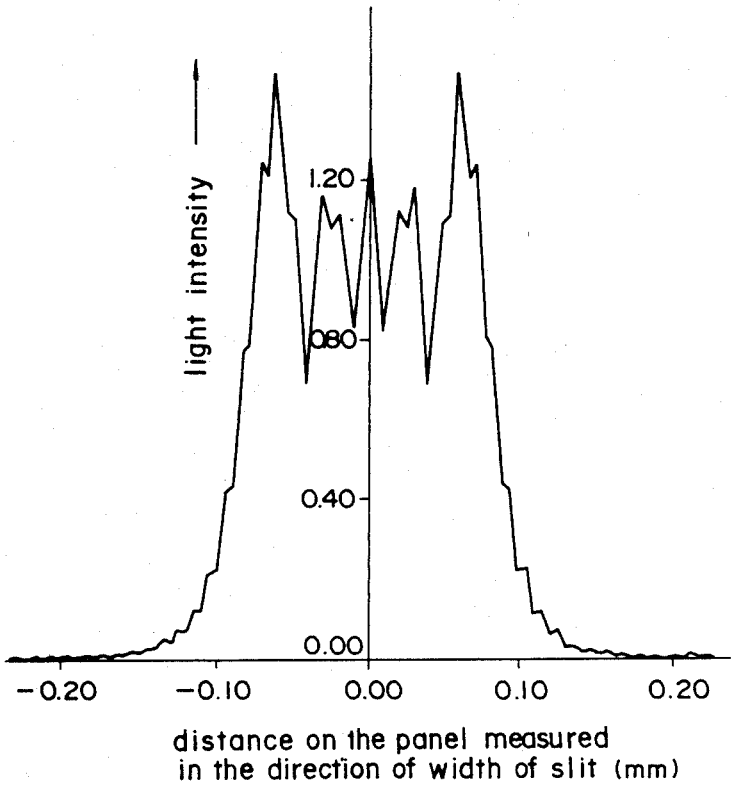
Figure 10:
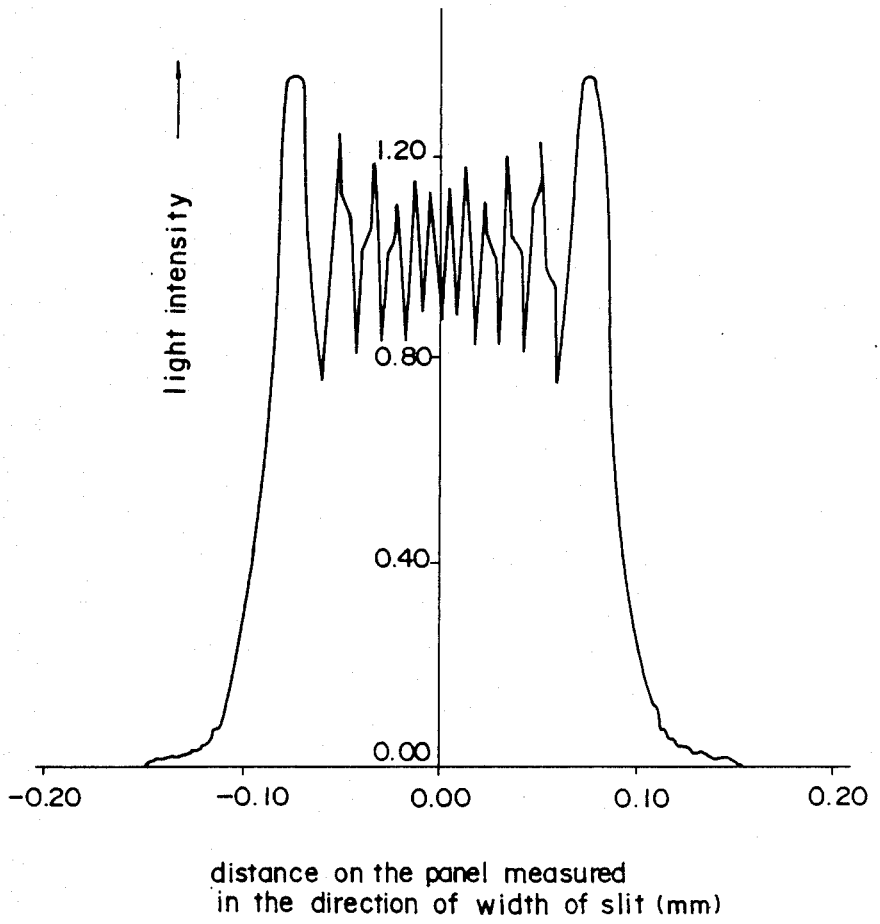

The slit width $A_O$ in the central portion of the mask 3, and the slit width $A_1$ in the peripheral portion of the mask 3 are dependent on design conditions for the fluorescent screen, and $b_c$ is dependent on the curvature of the panel IP. For example, when the ratio h=0.9, the slit width $A_O$=0.2 mm, the slit width $A_1$=0.18 mm (slit width at the outer end of the effective area of the fluorescent screen), $b_c$=3.7 mm, and $b_0$=19.5 mm, F=3.2 and a diffraction pattern as shown in FIG. 5 is formed over the entire area of the panel 1P. Accordingly, the photosensitive film is exposed uniformly over the entire area of the panel 1P.

Thus, in this embodiment, the same diffraction patterns are formed over the entire area of the inner surface of the curved panel 3 regardless of position by using the mask 3 formed of a flat glass plate, so that the entire area of the photosensitive film formed over the inner surface of the panel 1P can uniformly be exposed.

As apparent from the foregoing description, according to the present invention, stripes respectively having different predetermined widths can be formed by exposing the photosensitive resin film 2 formed over the inner surface of the panel 1P by a single exposure cycle using a single light source even if the mask 3 having slits is disposed at a finite distance from the panel 1P.

Furthermore, according to the present invention, the same diffraction patterns are formed over the entire area of the inner surface of the curved panel 1P, regardless of position in exposing the photosensitive resin film 2 formed over the inner surface of the curved panel 1P, by using the flat mask 3 which can easily be manufactured at a low cost.

Although the invention has been described in its preferred form with a certain degree of particularity, obviously many changes and variations are possible therein. It is therefore to be understood that the present invention may be practiced otherwise than specifically described herein without departing from the scope and spirit thereof.

What is claimed is:

1. A method of forming a fluorescent screen for a color CRT comprising the steps of exposing a photosensitive film formed over the inner surface of a curved panel for a color CRT simultaneously to form stripes respectively having different stripe widths by disposing a flat mask having slits opposite to the inner surface of the panel, said slits each having a width A which is a function of the distance b between the mask at the location of said slit and the inner surface of said panel, and a function of a constant factor F according to the expression:

$$F = A\sqrt{2/(b\lambda)}$$

where λ is the wavelength of light used for exposing the photosensitive film.

2. A method of forming a fluorescent screen for a color CRT according to claim 1, including the step of positioning said mask relative to the panel so as to meet a condition expressed by the expression:

$$b_0=b_c/\{1-A_1/A_0)^2\}$$

where $A_0$ is the slit width of the slits formed in the central portion of said mask, $A_1$ is the slit width of the slits formed in the peripheral portion of said mask, $b_0$ is the distance between said mask and the inner surface of the panel at the center of said mask, and $b_c$ is the difference between the distance $b_0$ and the distance $b_1$ between said mask and the inner surface of the panel at the periphery of said mask.

* * * * *